United States Patent [19]

Stangl

[11] 4,359,037

[45] Nov. 16, 1982

[54] IGNITION DEVICE

[75] Inventor: Walter Stangl, Wiesing, Austria

[73] Assignee: Jenbacher Werke Aktiengesellschaft, Jenbach, Austria

[21] Appl. No.: 190,756

[22] Filed: Sep. 25, 1980

[30] Foreign Application Priority Data

Oct. 1, 1979 [AT] Austria ..... 6389/79

[51] Int. Cl.[3] ..... F02P 1/00; F02P 5/00; F02P 9/00; F02P 5/12

[52] U.S. Cl. ..... 123/643

[58] Field of Search ..... 123/643, 416, 609; 315/209 T

[56] References Cited

U.S. PATENT DOCUMENTS

| | | | |
|---|---|---|---|
| 4,167,928 | 9/1979 | Pagel | 123/643 |
| 4,170,207 | 10/1979 | Boyama | 123/643 |
| 4,194,480 | 3/1980 | Rado | 123/643 |
| 4,208,992 | 6/1980 | Polo | 123/643 |
| 4,265,211 | 5/1981 | Meloeny | 123/643 |
| 4,269,152 | 5/1981 | Van Siden, Jr. | 123/643 |

*Primary Examiner*—Raymond A. Nelli
*Attorney, Agent, or Firm*—Karl F. Ross

[57] ABSTRACT

An ignition device for multi-cylinder internal-combustion engines comprising at least one spark plug for each cylinder. Each spark plug is arranged in the secondary circuit of an ignition transformer. The primary circuits of the ignition transformers are connectable with a source of energy by an ignition distributing circuit.

5 Claims, 1 Drawing Figure

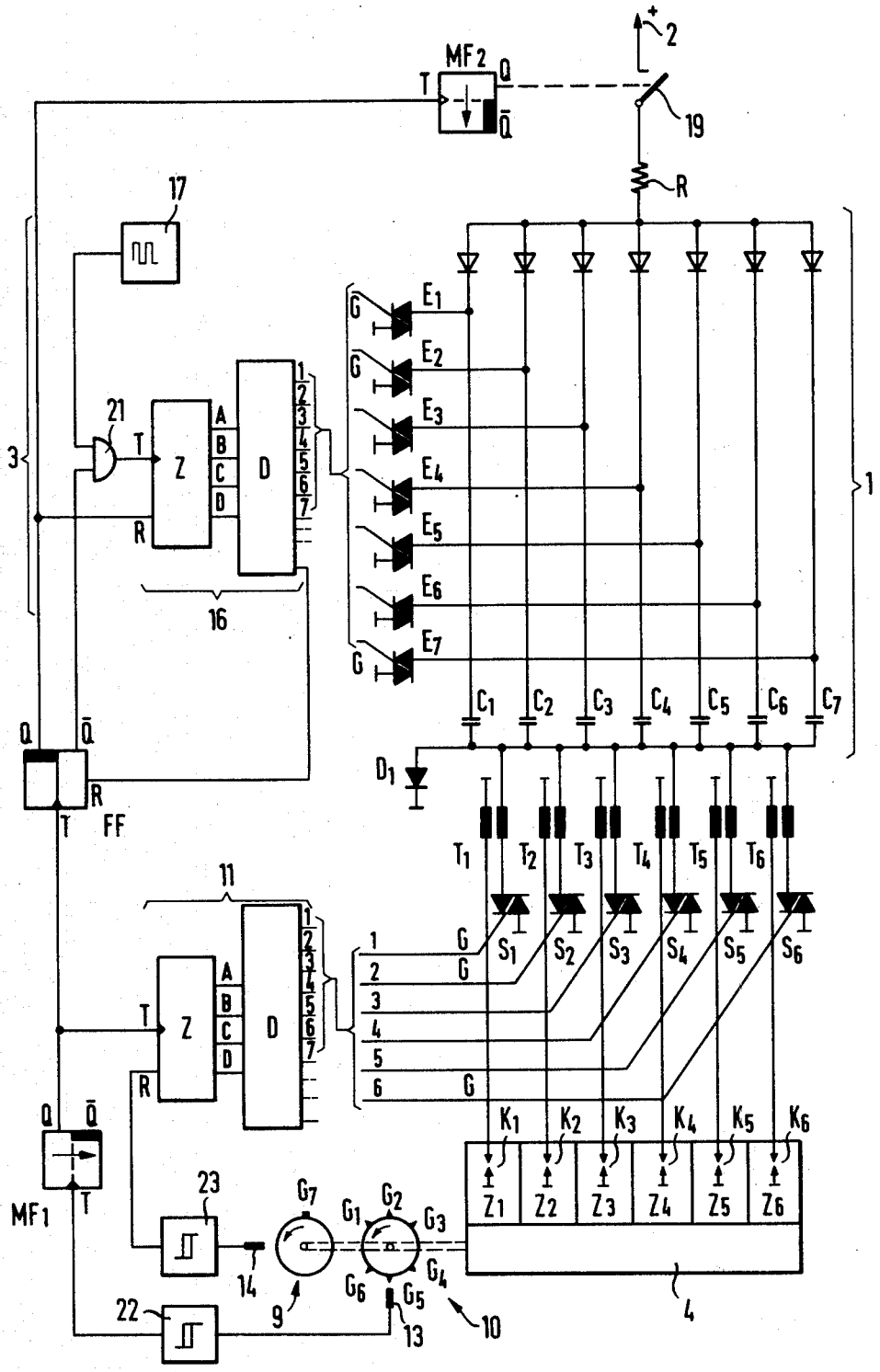
MF2
T
Q
Q̄
2
19
R
17
21
3
Z
A
B
C
D
D
1
2
3
4
5
6
7
16
E1
E2
E3
E4
E5
E6
E7
G
1
C1
C2
C3
C4
C5
C6
C7
D1
Q
Q̄
R
T
FF
T1
T2
T3
T4
T5
T6
11
S1
S2
S3
S4
S5
S6
K1
K2
K3
K4
K5
K6
Z1
Z2
Z3
Z4
Z5
Z6
MF1
23
22
G7
G1
G2
G3
G4
G5
G6
14
9
13
10
4

IGNITION DEVICE

FIELD OF THE INVENTION

The present invention relates to an ignition device for multi-cylinder internal-combustion engines comprising at least one spark plug for each cylinder, each of said spark plugs being arranged in the secondary circuit of an ignition transformer, the primary circuits of said ignition transformers being connectable with a source of energy by ignition distribution circuitry.

BACKGROUND OF THE INVENTION

Prior-art ignition devices for multi-cylinder internal-combustion engines partly employ mechanical ignition distributors arranged in the secondary circuit of an ignition transformer. The disadvantages of such ignition distributors are well known, particularly with respect to the wear of circuit-breaking elements.

It has already been suggested to associate an ignition transformer with each cylinder adapted to be separately fired, the primary circuits of the ignition transformers being connectable with an ignition capacitor by means of controllable electronic switches which act as an ignition distributor. The control inputs of these switches are connected with a number of sensors corresponding to the sequence of ignition, sensors being activated an initiator synchronously rotating with the crankshaft. This arrangement is not satisfactorily when employed with motors having a great number of cylinders as, e.g. in motors with eighteen cylinders, since in these cases it is extremely complicated to mount and adjust the sensors.

OBJECT OF THE INVENTION

It is the object of the present invention to eliminate the above-indicated adverse effects.

SUMMARY OF THE INVENTION

In accordance with the present invention this is achieved by providing ignition distributing means with a trigger means positively coupled to the internal-combustion engine and clocking a step-by-step actuator controlling successive switches connecting the respective primary circuits of the associated ignition transformer with the source of energy.

The distribution of ignition is thus carried out by the step-by-step actuator, and the number of electrical and mechanical elements is kept very low. It is a further advantage that the whole period between the operating cycles of two consecutive cylinders is available for the transmission of ignition energy.

In a preferred embodiment a reset initiator resets the step-by-step actuator into its initial state after an ignition cycle (i.e. after one rotation of the crankshaft). This ensures an absolutely synchronous running of the step-by-step actuator and the internal-combustion engine and, moreover, a single ignition device can be used independently of the number of cylinders of the internal-combustion engine. The ignition device in accordance with the present invention does not, therefore, limit the number of cylinders.

In another aspect of the invention the source of energy comprises a number of ignition capacitors, the first leads of said ignition capacitors being commonly connected with the primary circuits of the ignition transformers, the second leads of the ignition capacitors being individually connected with discharge switches, a programming circuit controlling said discharge switches. The programming circuit is triggered by said trigger means and discharges said number of ignition capacitors within one ignition interval. Any number of ignition impulses with adjustable energy can thus be transmitted within one ignition interval.

BRIEF DESCRIPTION OF THE DRAWING

In the following an embodiment of the ignition device for an internal-combustion engine in accordance with the present invention will be described in greater detail in connection with the sole FIGURE of the accompanying drawing which is a diagram of an ignition system for a six-cylinder motor.

SPECIFIC DESCRIPTION

The illustrated ignition device is provided for a stationary, large volume gas engine 4 comprising six cylinders $Z_1$–$Z_6$. Each of said cylinders has a spark plug $K_1$–$K_6$. The spark plugs $K_1$–$K_6$ are connected with the secondary windings of ignition transformers $T_1$–$T_6$. The first connections of the primary windings of the ignition transformers $T_1$–$T_6$ are individually connected with controllable, electronic distributing switches $S_1$–$S_6$, which are triacs in the present embodiment. The second connections of the primary windings of the ignition transformers $T_1$–$T_6$ are connected with a capacitive energy storage 1. The capacitive energy storage 1 comprises seven ignition capacitors $C_1$–$C_7$ adapted to be charged by a constant voltage supply 2 through protective diodes, a charging resistor and a charging switch 19, which is preferably electronic. The constant voltage supply 2 may be a battery, a generator or the like. Each of the ignition capacitors $C_1$–$C_7$ is connectable with the primary winding of a selectable ignition transformer by means of separate, controllable, electronic discharge switches $E_1$–$E_7$. These discharge switches are also triacs in the present embodiment.

A programming circuit 3 is provided for controlling the discharge switches $E_1$–$E_7$, said circuit comprising a step-by-step actuator 16 and a master clock 17.

Distributing switches $S_1$–$S_6$ are controlled by a step-by-step actuator 11. The two step-by-step actuators 11 and 16 each comprise a counting unit Z corresponding with a decoder D. A shift register or similar electronic structural units may equally be employed. The outputs of the decoder associated with the step-by-step actuator 11 are connected with the control inputs G of the distributing switches $S_1$–$S_6$ in accordance with the ignition sequence of the engine 4, whereas the outputs of the decoder D associated with the step-by-step actuator 16 are connected with the control inputs G of the discharge switches $E_1$–$E_7$ in accordance with the desired dispersion of ignition energy within one ignition interval. Trigger means 10 and a reset initiator 9 are provided for controlling the step-by-step actuator 11 and the programming circuit 3. The trigger means 10 and the reset initiator 9 are synchronously coupled with the crank shaft of the engine 4. The trigger means 10 comprise six magnetic initiators $G_1$–$G_6$ arranged on a rotary disc, the position of said initiators being scanned by a stationary sensor 13.

The reset initiator 9 also comprises a magnetic element $G_7$ (e.g. a steel bolt) arranged on a rotary disc and being scanned by a stationary sensor 14. Schmitt-triggers 22 and 23 are connected with the two sensors 13 and 14. The output of the Schmitt-trigger 22 is connected with the clock input of a monoflop $MF_1$, the output of said monoflop being connected with the clock input T of the step-by-step actuator 11 as well as with the clock input T of a flipflop FF. The output of the Schmitt-trigger 23 connected with the reset initiator 9 is connected with the reset input R of the step-by-step actuator 11. The output Q of the flipflop FF as well as the output of the master clock 17 are connected with the clock input T of the step-by-step actuator 16 by means of an AND, whereas the output Q of the flipflop FF is connected with the reset input of the step-by-step actuator 16 and, further, with the clock input of a monoflop $MF_2$. The monoflop $MF_2$ controls the charging switch 19.

In the following the function of the ignition device in the operation of the internal-combustion engine will be described.

Before an ignition interval starts the charging switch 19 controlled by the monoflop $MF_2$ closes for a pre-set time and, thus, connects the energy storage 1 with the constant voltage supply 2. Thereby the individual ignition capacitors $C_1$–$C_7$ are loaded by means of the charging resistor R, protective diodes and the diode $D_1$. The two step-by-step actuators 11 and 16 are in their initial positions, i.e. the outputs one through sixteen of the two decoders lie on logic 0. When the initiator $G_1$ of the trigger means 10 induces a signal in sensor 13 the Schmitt-trigger 22 triggers the monoflop $MF_1$ from a certain threshold onwards. Hence, an impulse reaches the clock input T of the step-by-step actuator 11, the impulse switching the counting means by one step so that a control signal appears at the output one of the decoder D. The control signal closes distributing switch $S_1$, for example. At the same time the impulse of monoflop $MF_1$ is applied to the clock input of flipflop FF and evaluated as ignition time. Flipflop FF releases AND-GATE 21 and the master clock 17 clocks the step-by-step actuator 16. At each pulse of said master clock a control impulse appears at the output of the decoder D. The control pulse closing the respective discharge switch $E_1$–$E_7$ via control inputs G. Hence, the ignition capacitors $C_1$–$C_7$ are discharged by the primary circuit of the selected ignition transformer $T_1$. The discharge of the individual ignition capacitors $C_1$–$C_7$ can, as already indicated, be carried out step by step. It is, however, also possible to vary the step intervals and, thus, the time sequence of the ignition spark by suitable switching. It is also possible to discharge several ignition capacitors at the same time. The last output of the step-by-step actuator 16 in respect of time switches flipflop FF again into its initial position, whereby AND-GATE 21 is locked and the monoflop $MF_2$ released. Said monoflop closes again charging switch 19 for a pre-set period of time.

The initiator $G_2$ associated with the next cylinder to be ignited triggers the step-by-step actuator 11, and the distributing switch $S_1$ next in the sequence of ignition is closed. At the same time the energy storage 1 is discharged. After an ignition cycle, i.e. after the ignition of all six cylinders $Z_1$–$Z_6$ and one rotation of the crank shaft, respectively, the reset initiator 9 creates an impulse in sensor 14, said impulse resets said step-by-step actuator 11 into its initial position.

It is obvious that the same ignition device can be used even when changing the number of cylinders. It will only be necessary to provide a corresponding number of initiators $G_n$.

It is finally pointed out that the number of ignition capacitors can be varied. It is also possible to employ different structural elements, e.g. thyristors or transistors, for the discharge switches and distributing switches.

When several spark plugs are used per cylinder, the plugs can be connected with separate energy storages 1 by means of separate ignition transformers. It is also possible, however, to feed a number of spark plugs by means of one energy storage.

What is claimed is:

1. An ignition device for a multi-cylinder internal combustion engine having at least one spark plug for each cylinder, said ignition device comprising:

a respective ignition transformer assigned to each of said spark plugs, each of said ignition transformers having a primary winding and a secondary winding;

a plurality of ignition capacitors, commonly connected on one side with the primary windings of said transformers and being individually connected on the opposite side to a charging current source;

a respective discharge switch connected to each of said capacitors;

a first control circuit connected to said discharge switches for operating same in a preprogrammed step-by-step sequence, said capacitors each being connected in circuit with at least one of said discharge switches and each discharge switch being connected in circuit with at least one of said capacitors whereby the energy level applied through the respective primary windings is controlled by the operation of said switches by said first control means for each spark plug firing;

respective ignition distributing switches connected between each primary winding and said source and operable independently of said discharge switches;

second control means including a step-by-step actuator operatively connected to said ignition distributing switches for successive operation thereof;

means for connecting each of said primary windings to a respective spark plug; and trigger means positively connected to said internal combustion engine for clocking said actuator and simultaneously activating said first control circuit to select the respective energy level per spark plug firing.

2. An ignition device according to claim 1, wherein a reset initiator is coupled to said internal-combustion engine, said reset initiator resetting said step-by-step actuator into its initial position after an ignition cycle.

3. An ignition device according to claim 2 wherein said reset initiator rotates synchronously with the crank shaft, the position of said initiator being scanned by a first stationary sensor.

4. An ignition device according to claim 1, wherein said trigger means comprise a number of initiators corresponding to the number of cylinders adapted to be separately ignited, said number of initiators rotating synchronously with the crank shaft, the positions of said number of initiators being scanned by a second stationary sensor.

5. An ignition device according to claim 1, 2, 3 or 4 wherein said step-by-step actuator comprises a shift register, the clock input of said shift register being connected with said second stationary sensor, the reset input of said shift register being connected with said first stationary sensor, the outputs of said shift register being connected with the control inputs of said switches.

* * * * *